US005280152A

United States Patent [19]

Lee

[11] Patent Number: 5,280,152

[45] Date of Patent: Jan. 18, 1994

[54] ELECTRIC STOVE WITH ELECTROMAGNETIC INDUCTION COOKER AND HOT PLATE

[76] Inventor: Yue Tsan Lee, No. 26, Lane 197, Sec. 2, Cheng Tai Rd., Wuku Hsiang, Taipei, Taiwan

[21] Appl. No.: 45,750

[22] Filed: Apr. 14, 1993

[51] Int. Cl.[5] ..... H05B 6/12

[52] U.S. Cl. ..... 219/10.493; 219/10.47; 219/10.67; 219/444; 312/236; 99/451

[58] Field of Search ..... 219/10.493, 10.47, 10.67, 219/10.79, 10.75, 444, 443; 99/451, DIG.14; 312/236

[56] References Cited

U.S. PATENT DOCUMENTS 2,491,529 12/1949 Spreen ..... 219/444
2,526,476 10/1950 Ham ..... 219/444
3,632,982 1/1972 Linger ..... 219/447
4,468,548 8/1984 Yamaki ..... 219/10.47
4,983,799 1/1991 Bonnet et al. ..... 219/10.493
4,996,405 2/1991 Poumey et al. ..... 219/10.493

*Primary Examiner*—Philip H. Leung
*Attorney, Agent, or Firm*—Lowe, Price, LeBlanc & Becker

[57] ABSTRACT

An electric heating stove including an electric hot plate made to slide in and out of a horizontal compartment in an electromagnetic induction cooker, and a positive temperature coefficient heater fastened to the electric hot plate and controlled by the control switches on the face panel of the electromagnetic induction cooker to release heat through a heat conductive plate on the electric hot plate for toasting food.

1 Claim, 5 Drawing Sheets

ELECTRIC STOVE WITH ELECTROMAGNETIC INDUCTION COOKER AND HOT PLATE

BACKGROUND OF THE INVENTION

The present invention relates to electric heating stoves, and more specifically to an electric heating stove comprised of an induction cooker, and an electric hot plate made to slide in and out of a horizontal compartment in the induction cooker.

Various electromagnetic induction cookers are known and widely accepted for the advantage of easy and convenient of use. However, special containers should be used to contain food when cooked on these electromagnetic induction cookers.

SUMMARY OF THE INVENTION

The present invention provides an electric heating stove comprised of an electromagnetic induction cooker, an electric hot plate made to slide in and out of a horizontal compartment on the electromagnetic induction cooker. The electric hot plate has a positive temperature coefficient heater controlled by the control switches on the face panel of the electromagnetic induction cooker to maintain a constant temperature for toasting food. An alteration switch is made on the face panel of the electromagnetic induction cooker to control the operation of the electric hot plate and the electromagnetic induction cooker alternatively. As the electric hot plate is made to slide in and out of the horizontal compartment of the electromagnetic induction cooker, it can be conveniently installed. When not in use, the electric hot plate can be received inside the electromagnetic induction cooker to minimize space occupation. As the electric heating stove is comprised of an electric hot plate and an electromagnetic induction cooker, it can be used for cooking food as well as toasting meat.

DETAILED DESCRIPTION OF THE PREFERRED EMBODIMENT

Figure 1:
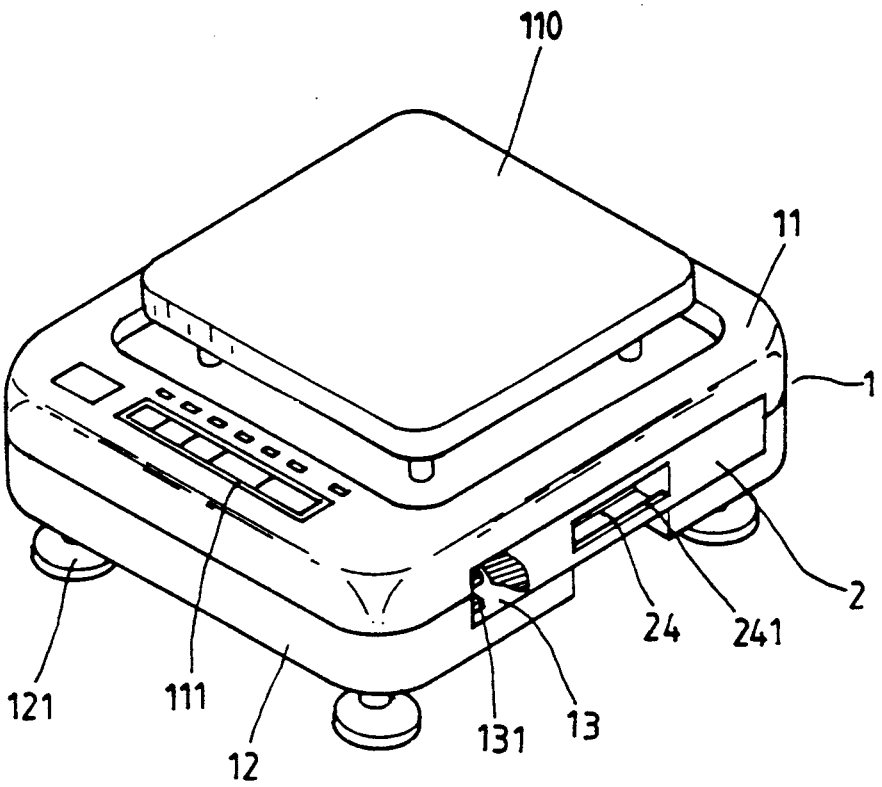
FIG. 1 is a perspective view of an electric heating stove according to the present invention.
Figure 2:
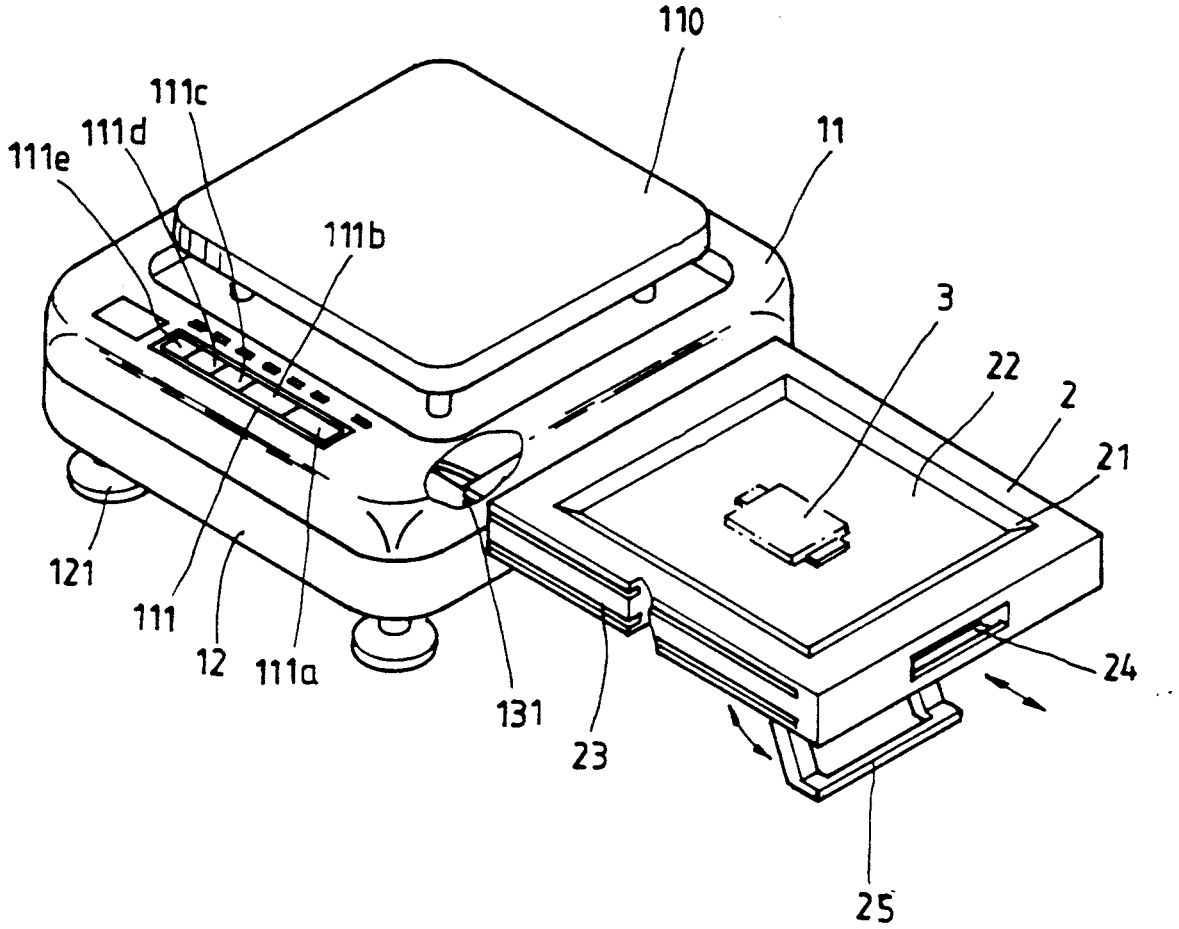
FIG. 2 is similar to FIG. 1 but showing the electric hot plate drawn out of the electromagnetic induction cooker.
Figure 3:
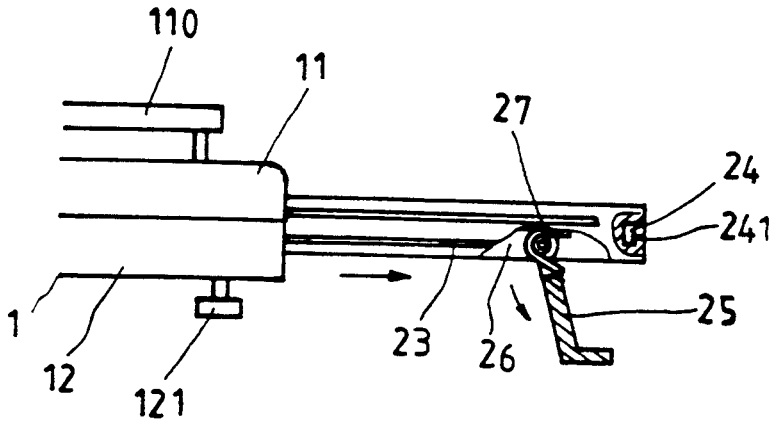
FIG. 3 illustrates the stand of the electric hot plate automatically turned to the operative position to support the electric hot plate as the electric hot plate is drawn out of the electromagnetic induction cooker.

Referring to FIGS. 1, 2 and 3, an electric heating stove in accordance with the present invention is generally comprised of an electromagnetic induction cooker 1, an electric hot plate 2, and a PTC (positive temperature coefficient) heater 3.

The electromagnetic induction cooker 1 comprises a bottom shell 12 supported on stands 121, a face panel 11 covered on the bottom shell 12 to hold a NEG (negative temperature coefficient) plate 110 at the top, and an electric circuit assembly (not shown) on the inside. The electric circuit assembly is of the known art, and therefore no further description is needed. The face panel 11 has a series of control switches 11 including a power switch 111*a*, a time switch 111*b*, a turbo switch 111*c*, an alteration switch 111*d*, and a high/low temperature control switch 111*e*. A horizontal compartment 13 is made on the induction cooker 1 between the face panel 11 and the bottom shell 12. The horizontal compartment 13 comprises two opposite pairs of parallel rails 131 for sliding the electric hot plate 2.

The electric hot plate 2 comprises a heat conductive plate 22 on a top recess 21 thereof, two opposite pairs of parallel grooves 23 on two opposite lateral sides thereof into which the opposite pairs of parallel rails 131 are respectively engaged as the electric hot plate 2 is inserted in the horizontal compartment 13 of the electromagnetic induction cooker 1, an upward flange 241 on the bottom of a hand hole 24 on a front side thereof for holding with the hand, and a stand 25 pivotally secured at the bottom by a torsional spring 27. The torsional spring 27 automatically forces the stand 25 into the operative position as the electric hot plate 2 is drawn out of the horizontal compartment 13 (see FIG. 3).

The PTC heater 3 is fastened to the heat conductive plate 22 at the bottom, and suitable for 110 VAC as well as 240 VAC. It may be comprised of one or more induction coils, and it regulates the electric current passing automatically so as to maintain a constant temperature.

Figure 4:
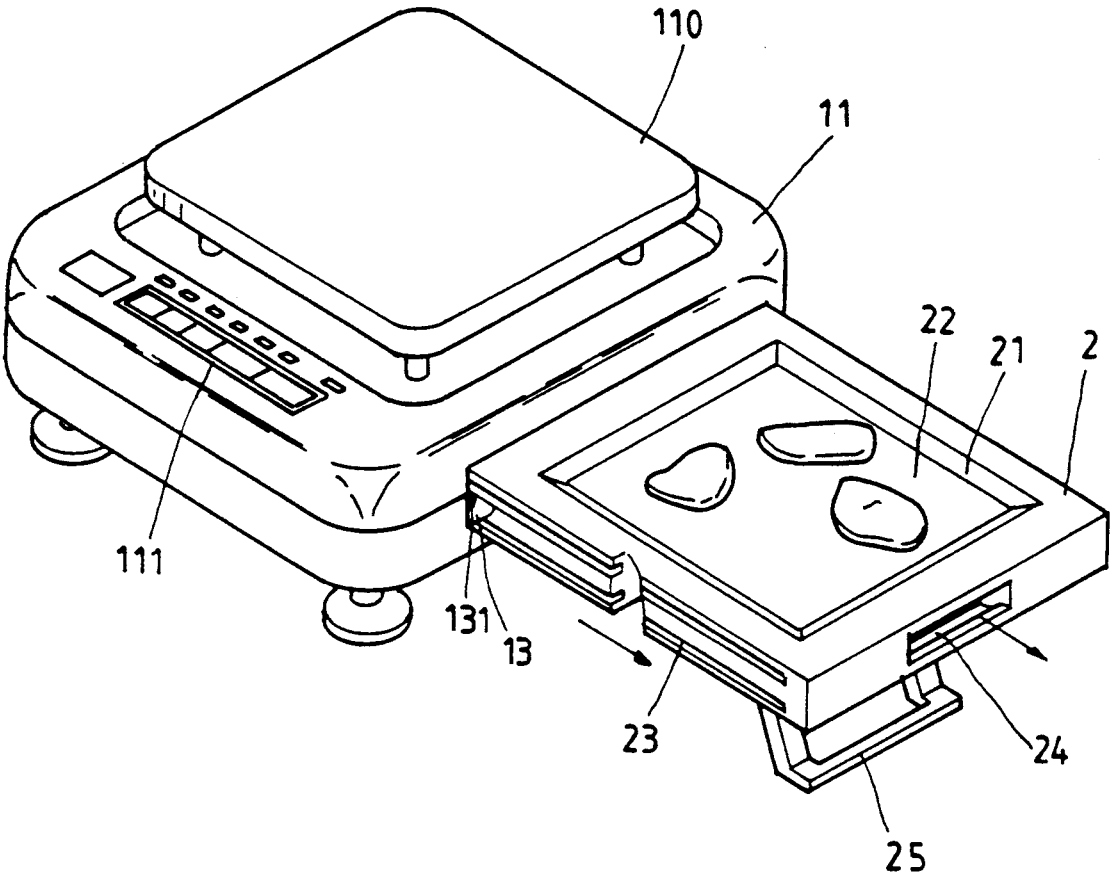
FIG. 4 illustrates an application of the electric hot plate.
Figure 5:
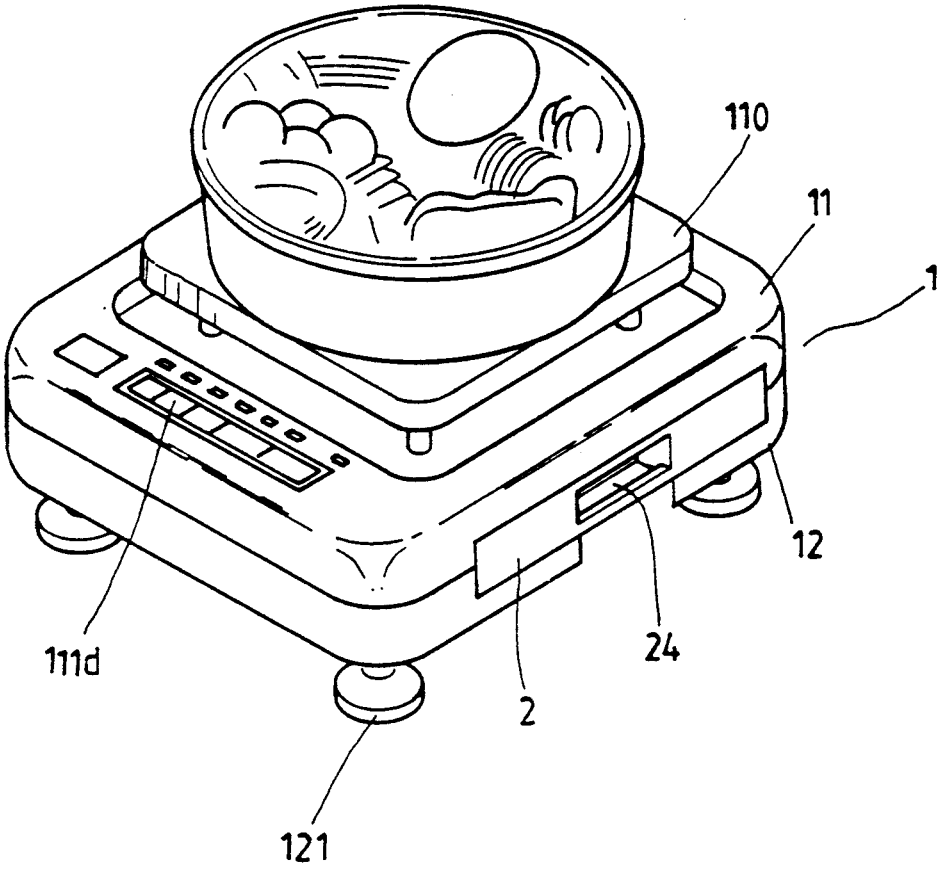
FIG. 5 illustrates an application of the electromagnetic induction cooker.

Referring to FIGS. 4 and 5 and FIG. 3 again, the electric hot plate 2 can be drawn out of the horizontal compartment 13 with the hand through the hand hole 24. As soon as the electric hot plate 2 is drawn out of the horizontal compartment 13, the stand 25 is automatically turned to the operative position by the torsional spring 27 to support the electric hot plate 2 in place. Food can then be directly placed on the heat conductive plate 22 for toasting, or contained in a special container and then placed on the NEG plate 110 for cooking. The alteration switch 111*d* is to switch electric power supply to the NEG plate 110 or the PTC heater 3. The radiant heat of the PTC heater 3 is transmitted through the heat conductive plate 22 to toast food. The PTC heater 3 can produce a constant temperature as high as 230° C. It takes only 20 seconds to increase the temperature of the PTC heater 3 from 0° C. to 230° C., and takes about 2 minutes to transmit the heat to the heat conductive plate 22.

What is claimed is:

1. An electric heating stove comprised of an electromagnetic induction cooker, an electric hot plate, and a positive temperature coefficient heater, wherein:

said electromagnetic induction cooker comprises a bottom shell supported on stands, a face panel covered on the bottom shell to hold a negative temperature coefficient plate at the top, and a horizontal compartment between said face panel and said bottom shell, said face panel having a power switch, a time switch, a turbo switch, an electromagnetic induction cooker/electric hot plate alteration switch, and a high/low temperature control switch, said horizontal compartment having two opposite pairs of parallel rails on two opposite sides for sliding said electric hot plate;

said electric hot plate comprises a heat conductive plate on a top recess thereof, two opposite pairs of parallel grooves on two opposite lateral sides thereof into which said two opposite pairs of parallel rails are respectively engaged, a handhold on a front side thereof, and a stand pivotally secured to a bottom wall thereof by a torsional spring, said torsional spring being to give a downward pressure to the stand of said electric hot plate; and said positive temperature coefficient heater is fastened to said heat conductive plate at the bottom, and controlled by the switches on said face panel of said electromagnetic induction cooker to release heat for toasting food through said heat conductive plate.

* * * * *